US008393675B2

(12) United States Patent
Swanson

(10) Patent No.: US 8,393,675 B2
(45) Date of Patent: Mar. 12, 2013

(54) FURNITURE PROTECTION SYSTEMS AND METHOD

(76) Inventor: Kevin Swanson, Elk River, MN (US)

( * ) Notice: Subject to any disclaimer, the term of this patent is extended or adjusted under 35 U.S.C. 154(b) by 225 days.

(21) Appl. No.: 12/967,872

(22) Filed: Dec. 14, 2010

(65) Prior Publication Data

US 2011/0140490 A1 Jun. 16, 2011

Related U.S. Application Data

(60) Provisional application No. 61/286,446, filed on Dec. 15, 2009.

(51) Int. Cl.
*A47C 31/00* (2006.01)

(52) U.S. Cl. ..... 297/226; 297/229; 297/228.13

(58) Field of Classification Search ..... 297/219.1, 297/226, 228.1, 229, 228.13, 463.1
See application file for complete search history.

(56) References Cited

U.S. PATENT DOCUMENTS 2,833,341 A * 5/1958 Bornstein ..... 297/229
3,185,523 A * 5/1965 Morrill, Jr. ..... 297/226
3,311,408 A 3/1967 Sarvas
4,709,430 A 12/1987 Nicoll
4,838,610 A 6/1989 Perrin
5,308,141 A * 5/1994 Robinson et al. ..... 297/218.4
5,547,249 A * 8/1996 Riley et al. ..... 297/228.13
5,549,355 A 8/1996 Illulian
5,611,595 A 3/1997 Gatehouse
5,636,897 A 6/1997 Zapf
5,829,828 A * 11/1998 Asfaw ..... 297/219.1
6,409,264 B1 6/2002 Palmer et al.
7,690,725 B1 * 4/2010 Rawlings ..... 297/229
2003/0145380 A1 8/2003 Schmid

OTHER PUBLICATIONS

Tuck N Throw by U.N.I.C, Retrieved from the Internet: <URL: http://tucknthrow.com/Portfolio_A207.php> [retrieved on Jun. 17, 2010].

* cited by examiner

*Primary Examiner* — Milton Nelson, Jr.
(74) *Attorney, Agent, or Firm* — Fish & Richardson P.C.

(57) ABSTRACT

Some embodiments of a furniture cover device provide a protective covering for a selected furniture piece, such as a couch, loveseat, or chair, and the furniture cover device can be readily removed or repositioned by user. In particular embodiments, the furniture cover device includes a main body comprising a flexible web and a plurality of elongate anchor members extending in a parallel manner through the flexible web.

20 Claims, 5 Drawing Sheets

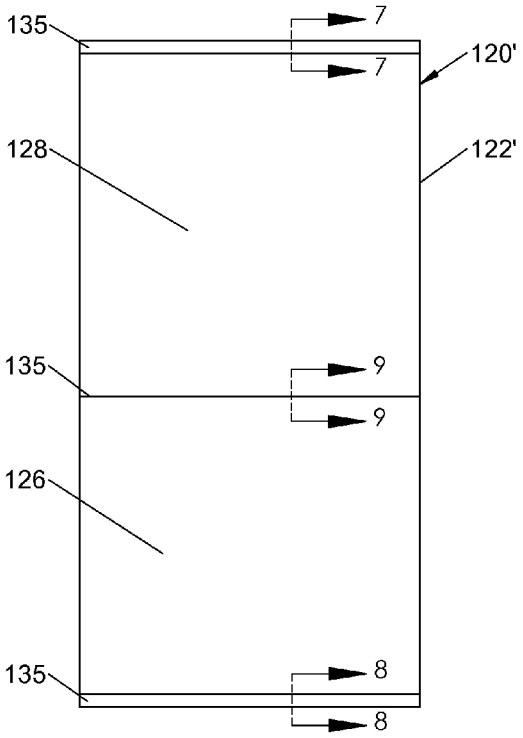
FIG. 6
FIG. 7
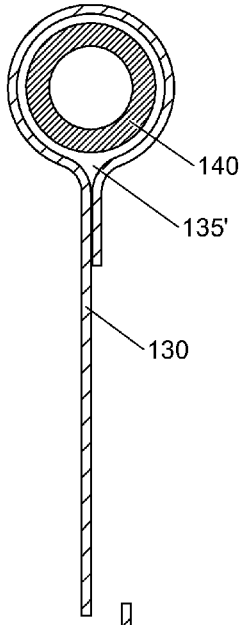
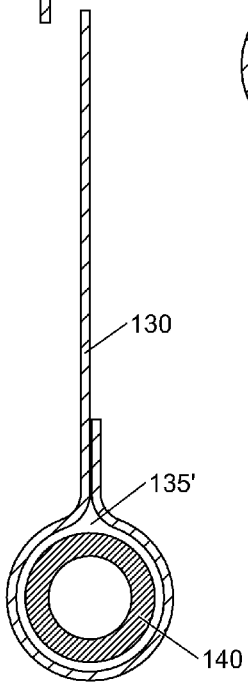
FIG. 8
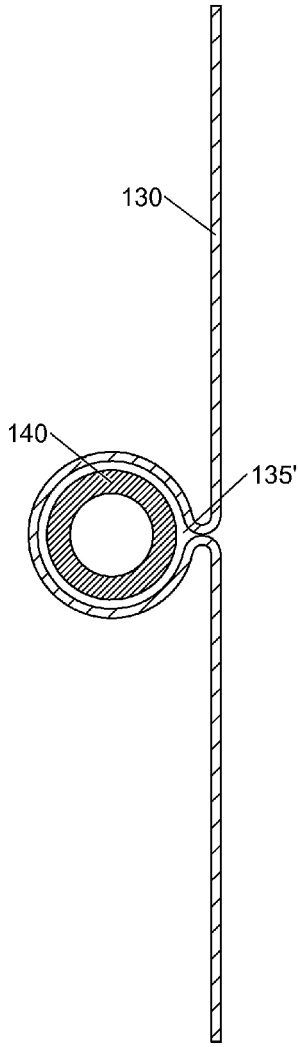
FIG. 9

FURNITURE PROTECTION SYSTEMS AND METHOD

CROSS-REFERENCE TO RELATED APPLICATION(S)

This application claims priority to U.S. Provisional App. No. 61/286,446 filed on Dec. 15, 2009 and entitled "Furniture Protection Systems and Methods," the entire contents of which are expressly incorporated herein by reference.

TECHNICAL FIELD

This document relates to a furniture cover device and methods related thereto.

BACKGROUND

A number of furniture pieces, such as couches, chairs, loveseats, and the like, may be covered in upholstery that is susceptible to damage or deterioration. For example, some furniture pieces may be exposed during ordinary use to damage or soiling from pets, ordinary wear and tear, spills from food or drink, burns from cigarettes or other combustible items, or other deterioration. In some cases, the furniture pieces must be reupholstered in order to repair or restore the furniture to a suitable appearance.

Traditionally, attempts were made to protect some furniture pieces from damage or deterioration by use of a slip cover on the furniture. Some furniture pieces having particular dimensions are unable to receive a close fitting slip cover unless it is custom made at a high expense. For those furniture items that are able to receive a slip cover, the slip cover is often difficult to promptly install or remove of the targeted furniture piece. In addition, the slip cover may be susceptible to sliding or migrating along the furniture piece when users repeatedly sit on or other wise the covered furniture item.

SUMMARY

Some embodiments of a furniture cover device provide a protective covering for a selected furniture piece, such as a couch, loveseat, or chair that can be readily removed or repositioned by user. The furniture cover device can protect the seating surfaces of the furniture piece from damage or deterioration caused by ordinary use or by household pets. In particular embodiments, the furniture cover device includes a main body comprising a flexible web and a plurality of elongate anchor members extending in a parallel manner through the flexible web. The elongate members removably secure the flexible web in a selected position on seating surfaces of the furniture piece so that the flexible web operates as a protective covering for the seating surfaces. In the event that the furniture covering device need be removed, a user can readily grasp any one of the elongate anchor members to lift the entire furniture cover device from the furniture piece, preferably, with a single arm motion.

In particular embodiments, a furniture protection system may include a furniture piece such as a couch, a loveseat, a chair, or a chase. The furniture piece may include one or more seating surface cushions, one or more back cushions extending from the seating surface cushions toward a top side of the of the furniture piece, an a longitudinal gap defined between the one or more seating surface cushions and the one or more back cushions. The system may further include a furniture cover device removably mounted to the furniture piece so as to at least partially cover the one or more seating surface cushions and the one or more back cushions. The furniture cover device may include a main body comprising a web of flexible material that defines a plurality of longitudinal channels extending substantially the entire longitudinal length of the main body. The furniture cover device may also include a plurality of elongate anchor members arranged in the plurality of longitudinal channels. Each elongate anchor member may be removably received in a corresponding one of the longitudinal channel such that the plurality of elongate anchor members extend in a longitudinal direction generally parallel to another. The furniture cover device can be retained in a selected position on the furniture piece when a central elongate anchor member of the plurality of elongate anchor members is arranged in the longitudinal gap defined between the one or more seating surface cushions and the one or more back cushions.

In some embodiments, a furniture cover device includes a furniture covering body that comprises a web of flexible material defining three longitudinal channels extending substantially the entire longitudinal length of the furniture covering body. The web of flexible material may include a front layer and a rear layer with the three longitudinal channels defined therebetween. The three longitudinal channels may include a lower longitudinal channel positioned adjacent to a lower edge of the furniture covering body, an upper longitudinal channel position adjacent to an upper edge of the furniture covering body, and a central longitudinal channel positioned between the upper and lower longitudinal channels. A first body portion of the web of flexible material may be at least partially defined between the lower longitudinal channel and the central longitudinal channel, and a second body portion of the web of flexible material may be at least partially defined between the upper longitudinal channel and the central longitudinal channel. The device may further include three elongate anchor members removably comprising a flexible elastomeric material and being coupled with the web of flexible material. The three elongate anchor members may include a lower elongate anchor member slidably received in the lower longitudinal channel, a central elongate anchor member slidably received in the central longitudinal channel, and an upper elongate anchor member slidably received in the upper longitudinal channel. Each of the lower, central, and upper elongate anchor members may extend substantially the entire longitudinal length of the furniture covering body and extending generally parallel to one another. When the central elongate anchor member is removable mounted to a furniture piece, the lower elongate anchor member may create tension in the first body portion of the web of flexible material and the upper elongate anchor member may create tension in the second body portion of the web of flexible material.

Particular embodiments include a method a using a furniture covering device on a furniture piece. The method may include inserting central elongate anchor member into a crevice between at least one seating surface cushion and at least one back cushion of a furniture piece. The central elongate anchor member may be removably received in a central longitudinal channel extending through substantially the entire longitudinal length of a web of material. The method may further include positioning a lower elongate anchor member laterally away from the central anchor member and adjacent to a vertical leg pad of the furniture piece so as to create tension in the web of material. The lower elongate member may be removably received in a lower longitudinal channel extending through substantially the entire longitudinal length of the web of material proximate to a lower edge of the web of material. The method may further include positioning an upper elongate anchor member laterally away from the central anchor member and adjacent to a back portion of the furniture piece so as to create tension in the web of material. The upper elongate member may be removably received in an upper longitudinal channel extending through substantially the entire longitudinal length of the web of material proximate to an upper edge of the web of material. The method may further include lifting at least one of the central, lower, and upper elongate anchor members away from the furniture piece so as to remove the furniture cover device away from the furniture piece with a single arm motion.

These and other embodiments described herein may provide one or more of the following advantages. First, some embodiments of a furniture cover device may readily removed, repositioned or reinstalled on the same or any other piece of furniture to be protected. Such a configuration can provide significant convenience to a user that attempts to install the furniture cover prior to pets or children using the furniture piece or to a user that attempts to promptly remove the furniture cover for seating directly on the furniture piece by the user or a guest. Second, some embodiments to of a furniture protection system can provide sturdy anchor members that are readily removable from the web of material for purposes of machine-washing the web of material. Third, some embodiments of a furniture protection system may permit reversibility to allow even wear on all sides as well as multiple color options. Fourth, some embodiments of a furniture protection system may provide the ability to be used with or without the weighted members in an automobile or other non-furniture application. Fifth, some embodiments of a furniture protection system may provide the ability to roll the cover device into a coiled condition for quick and easy storage and portability.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 6 is a top view of a furniture cover device, in accordance with some embodiments.

FIG. 7 is a cross-section view of a portion of the furniture cover device of FIG. 6.

FIG. 8 is a cross-section view of a portion of the furniture cover device of FIG. 6.

FIG. 9 is a cross-section view of a portion of the furniture cover device of FIG. 6.

DETAILED DESCRIPTION OF ILLUSTRATIVE EMBODIMENTS

Figure 1:
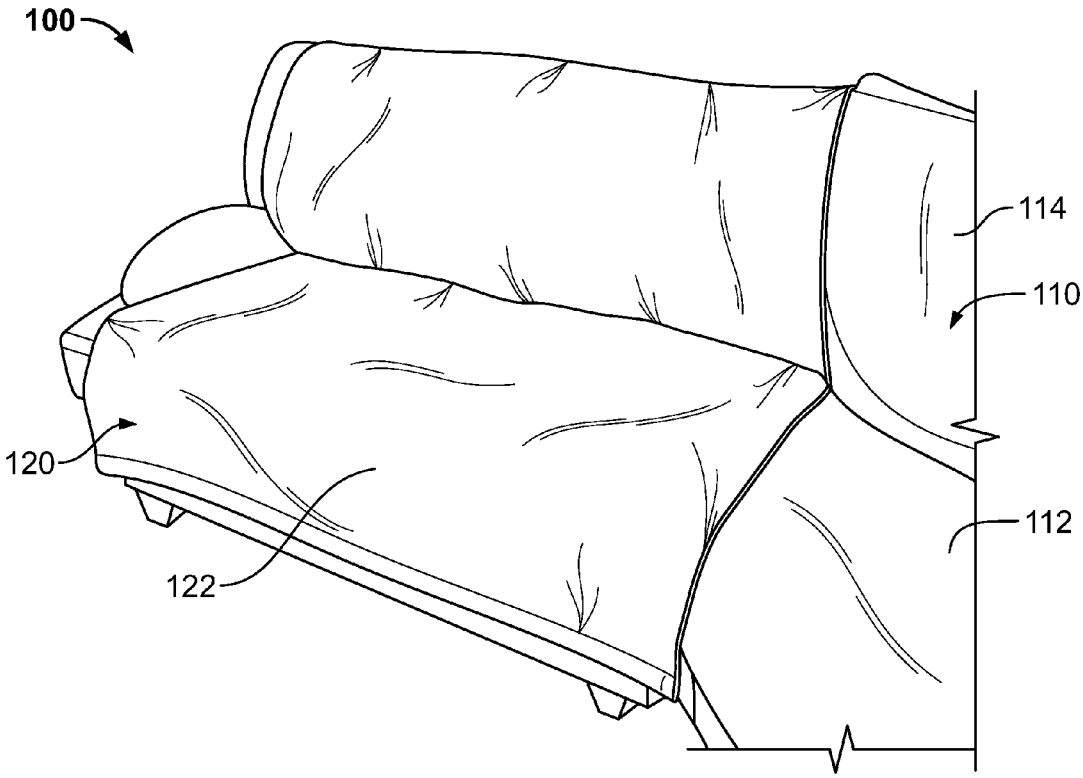
FIG. 1 is a perspective view of furniture protection system including a furniture cover device and a furniture piece, in accordance with some embodiments.

Referring to FIG. 1, some embodiments of a furniture protection system 100 can include a furniture piece 110 and a furniture cover device 120. In this embodiment, the furniture piece 110 comprises an upholstered couch having a plurality of seating surfaces 112, but in alternative embodiments the furniture piece 110 may include other items such as a chair, a chase, or the like. As described in more detail below, the furniture cover device 120 can be removably installed on the furniture piece 110 so as to provide protection to the seating surfaces 112 and other portions of the furniture piece during use. For example, the furniture cover deice 120 can be promptly applied to the couch 110 in this embodiment to reduce the likelihood of damage, soiling, or fur collection caused by one or more household pets that rest upon the couch 110. In this embodiment, the furniture cover device 120 can be promptly removed by user (preferably with a single arm motion) so that the device 120 can be readily lifted away (along with any soiling or fur collected thereon) to expose the clean seating surfaces 112 for use by visitors or guests.

Figure 2:
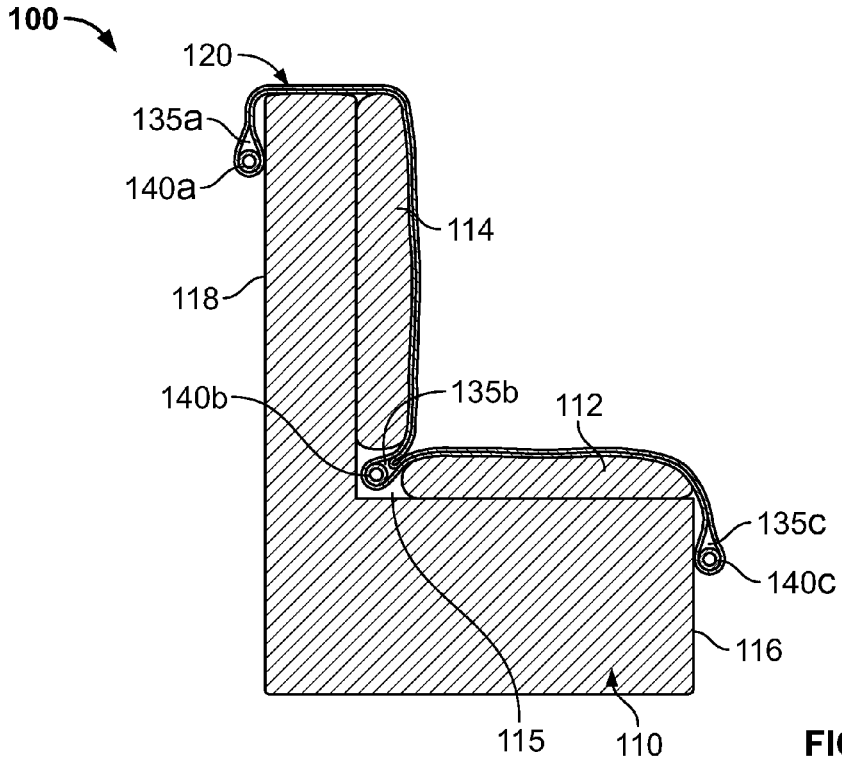
FIG. 2 is a cross-section view of the furniture protection system of FIG. 1.

Referring to FIGS. 1-2, some embodiments of the furniture piece 110 can include a couch, chair, loveseat or similar seating surface. Furniture piece 110 can include single or multiple seating surfaces 112 defined by seating cushions or the like Back cushions 114 may extend generally vertically relative to the seating cushion 112. In this embodiment a gap or other crevice is formed between the opposing surfaces of the seating cushion 112 and the back cushion 114. As described in more detail below, this crevice can be used to retain at least a portion the furniture cover device 120. A vertical leg pad 116 may extend generally vertically away from the ground to the seating surface 112. In this embodiment, a rear surface 118 or the furniture piece extends generally vertically away from the ground toward the top of the furniture piece and the upper portion of the back cushion 114.

Seating surfaces 112 and other portions may include an upholstered covering. In some cases, the upholstered covering may be susceptible to damage, soiling, or fur collection (caused by pets). Upholstered coverings can be comprised of any material for example cloth, leather or microfiber. In such circumstances, the furniture cover device 120 can be readily installed to generally cover and protect the seating surfaces 112 of the furniture piece 110.

Still referring to FIGS. 1-2, some embodiments of the furniture cover device 120 can include a main body 122 and a plurality of elongate anchor members 140. The main body 122 may comprise of a flexible web of material. For example, the web of material for the main body 122 may comprise fleece, canvas, duck cloth, flannel, polymer sheeting, polymer-fabric blends, or any combination thereof. As described in more detail below, a plurality of anchor members 140 can be coupled to the main body 122 so as to extend generally parallel to one another in a longitudinal direction. The anchor members 140 can provide for prompt installation and removal of the furniture cover device 120 while also providing a mechanism for securing the furniture cover device 120 to the furniture piece 110 during use.

Figure 3:
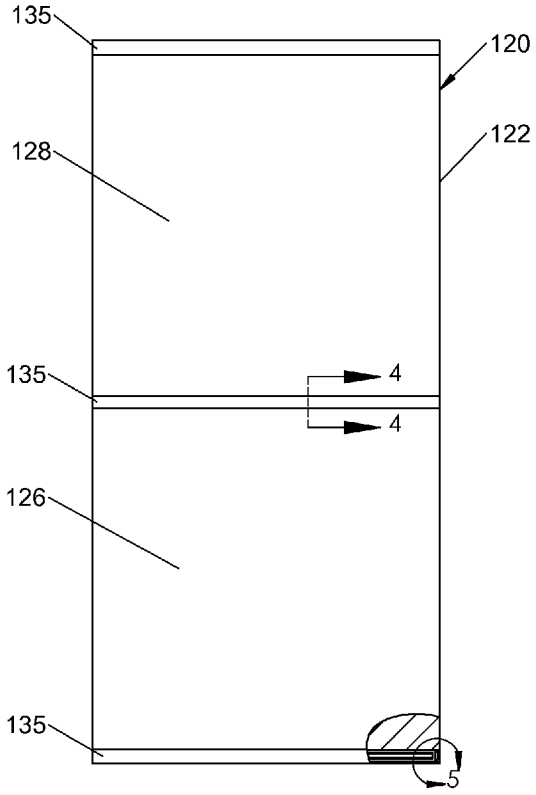
FIG. 3 is a top view of a furniture cover device, in accordance with some embodiments.
Figure 5:
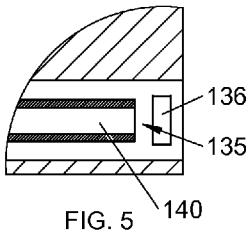
FIG. 5 is a cutaway view of furniture cover device of FIG. 3.

Referring now to FIGS. 3-5, some embodiments of the furniture cover device 120 may include at least three anchor members 140 arranged in channels 135 of the main body 122. In particular, one anchor member 140*b* (FIG. 2) can be generally centered along the main body 122 and two anchor members 140*a* and 140*c* (FIG. 2) are arranged proximate to opposing ends of the main body 122. As such, the main body 122 may be divided into two body portions 126 and 128, which are defined on opposing sides of the centrally located anchor member 140*b*. It this embodiment the two body portions 126 and 128 are generally equal in size to allow reversibility during installation onto the furniture piece 110. In alternative embodiments, the body portions 126 and 128 may have substantially different sizes for purposes of fitting onto particular furniture pieces.

Figure 4A:
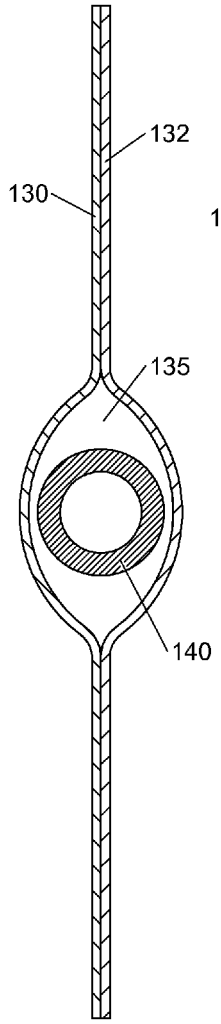
FIG. 4A is a cross-section view of the furniture cover device of FIG. 3.

Still referring to FIGS. 3-5, in some embodiments, the main body 122 comprises the flexible web of material, which can be machine-washable. The main body 122 may be constructed from multiple layers of flexible material, such as a front layer 130 and a rear layer 132 (FIG. 4A). In such circumstances, the front layer 130 and the rear layer 132 may comprise different materials, different textures, different colors, or a combination thereof. In some embodiments, the main body 122 of the furniture cover device 120 may have a width of about 20 inches to about 80 inches, about 40 inches to about 60 includes, about 45 inches to about 55 inches, and preferably about 50 inches in the depicted embodiment. Also, in some embodiments, the main body 122 of the furniture cover device 120 may have a height of about 60 inches to about 90 inches, about 70 inches to about 85 inches, about 78 inches to about 82 inches, and preferably about 80 inches in the depicted embodiment.

Figure 4B:
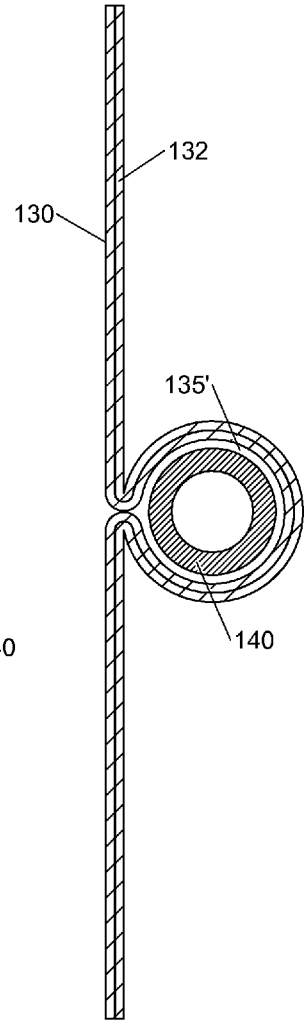
FIG. 4B is a cross-section view of the furniture cover device of FIG. 3 in accordance with alternative embodiments.

Still referring to FIGS. 3-5, in some embodiments, the front and rear layers 130 and 132 of the main body 120 can be fastened (e.g., via stitches, adhesive, or fabric fasteners, or the like) define a plurality of longitudinal channels 135 to receive the elongate anchor members 140. As shown in FIG. 4A, each channel 135 may be defined between inner faces of the front layer 130 and the rear layer 132, so that the interior of each channel 135 is generally concealed from view. Alternatively, as shown in FIG. 4B, at least one of the channels (e.g., centrally located channel 135') can be defined by the front layer 130 and the rear layer 132 being secured together to form a longitudinal loop structure to receive the anchor member 140. Each channel 135 may have a length that is greater than or equal to the length of the anchor members 140. The channels 135 may be open at one or both ends to allow the removal of the anchor members 140. Alternatively, the channels may have closed ends that can be subsequently opened (e.g., separating VELCRO tabs 136 as shown in FIG. 5, snaps, or other fasteners) for prompt removal of the corresponding anchor member 140 therein.

In the depicted embodiment, the device 120 includes three longitudinal channels 135: a central channel 135*b* (FIG. 2), a lower channel 135*c* (FIG. 2) adjacent to a lower edge of the main body 122, and an upper channel 135*a* (FIG. 2) adjacent to an upper edge of the main body 122. The portion of the main body 122 arranged between the lower channel 135*c* and the central channel 135*b* may at least partially define the first body portion 126. The portion of the main body 122 arranged between the upper channel 135*a* and the central channel 135*b* may at least partially define the second body portion 128.

Referring again to FIG. 2, some embodiments of the elongate anchor members 140*a-c* may serve as weighted portions that retain the main body 122 in a selected position on the furniture piece 110. The anchor members 140*a-c* may comprise a generally flexible material, such as rubber, another elastomeric material, or another polymer. The anchor members 140*a-c* may have a tubular body (e.g., a rubber, tubular hose construction) that is configured to slidably insert into the corresponding longitudinal channel 135*a-c* of the main body 122. Alternatively, the anchor members 140 may have a generally solid construction or may be filled with a secondary material (e.g., sand, metallic beads, or the like) to increase the overall weight the anchors members. Each of the plurality of anchor members 140*a-c* may have a generally similar weight. As previously described, each of the elongate anchor members 140*a-c* can be removably received in the main body 122 through the longitudinal channels 135 such that a user can readily remove the elongate anchor members 140 and then place the main body 122 in the a washing machine for purposes cleaning the main body 122.

Referring to FIGS. 2-3 in some embodiments the central elongate member 140*b* can be configured to rest in the central channel 135*b* that is friction fit into the crevice 115 between the seating surfaces 112 and the back cushions 114. The lower elongate anchor member 140*c* can be configured to rest in the lower channel 135*c*, which facilitates a tension force in the first body portion 126 of the main body. The upper elongate member 140*a* can be configured to rest in the upper channel 135*a* which is retain over a backside of the furniture piece 110, thereby creating a tension force the second body portion 128 of the main body 122. Accordingly, the furniture cover device 120 can be readily installed on the furniture piece 110 in a toolless manner and without the need to access the side and the full rear of the furniture piece 110. Moreover, the arrangement of the anchor members 140*a-c* can create a tension in the body portions 126 and 128 so as to the retain the furniture cover device 120 is a selected position during repeated uses while also maintaining a generally attractive appearance.

Referring to FIGS. 6-9, in some alternative embodiments, the furniture cover device 120' may include at least three anchor members 140 arranged in channels 135 of a main body 122' formed from a single layer of flexible web material. Similar to previously described embodiments, the main body 122' may comprise a single layer of fleece, canvas, duck cloth, flannel, polymer sheeting, or a polymer-fabric blend, and preferably the main body 122' is machine-washable. As shown in FIGS. 7-9, the single layer 130 of the main body 122' can define a plurality of longitudinal channels 135' to receive the elongate anchor members 140. For example, longitudinal portions of the single layer 130 can fastened together (e.g., via stitches, adhesive, or fabric fasteners, or the like) to form longitudinal loop structures to receive the anchor members 140. Similar to previously described embodiments, each channel 135' may have a length that is greater than or equal to the length of the anchor members 140. The channels 135' may be open at one or both ends to allow the removal of the anchor members 140, or the channels 135' may have closed ends that can be subsequently opened (e.g., separating VELCRO tabs, snaps, or other fasteners) for prompt removal of the corresponding anchor member 140 therein.

Figure 10:
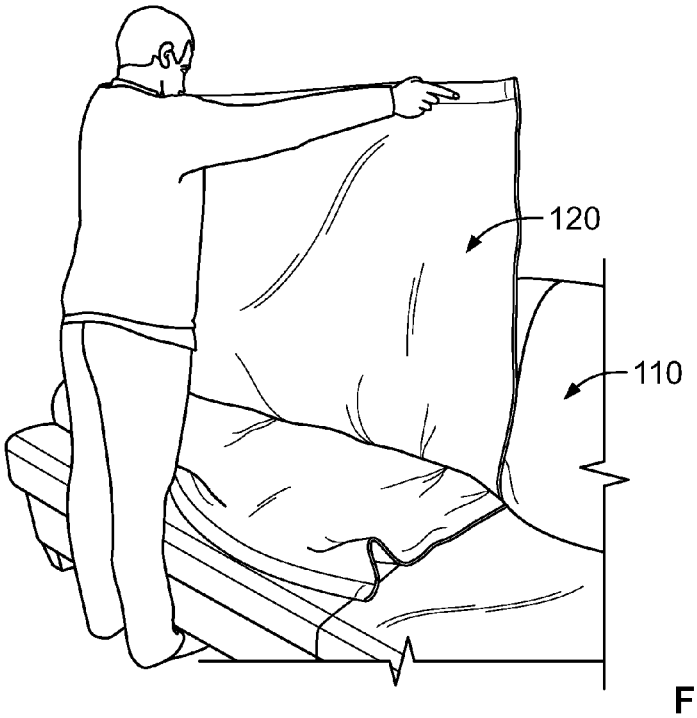
FIG. 10 is a perspective view of the furniture cover device of FIG. 3 being applied to a furniture piece, in accordance with some embodiments.
Figure 11:
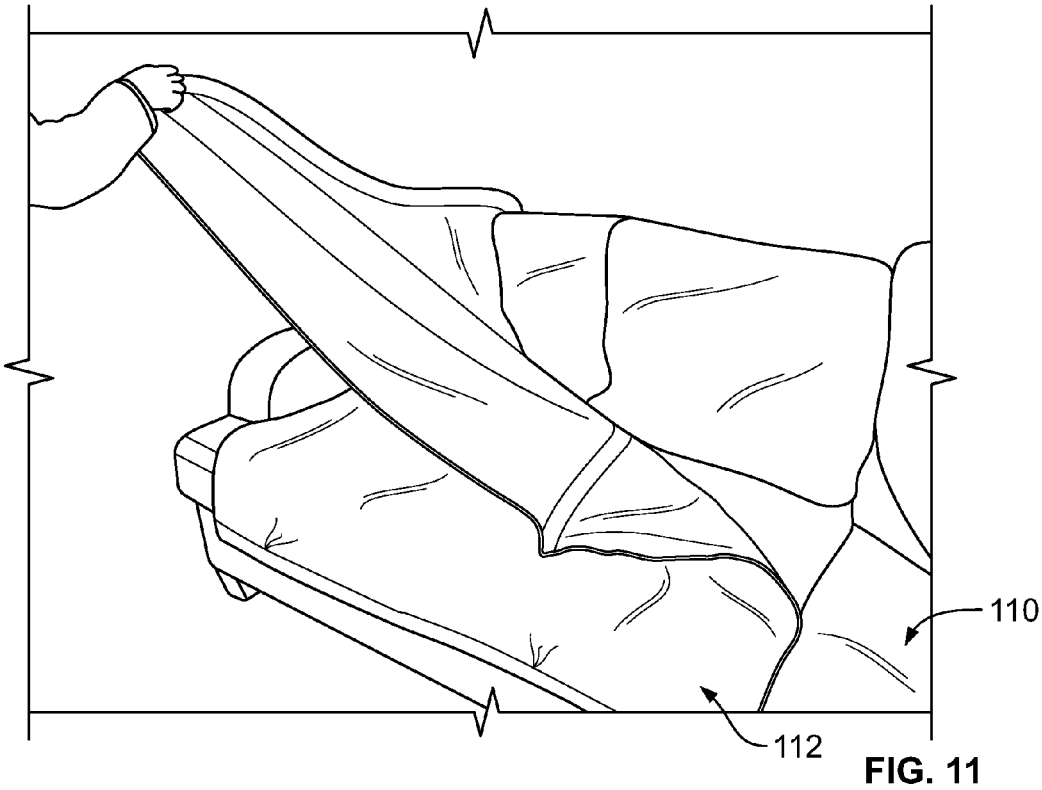
FIG. 11 is a perspective view of the furniture cover device of FIG. 10 being removed from the furniture piece with a single arm motion, in accordance with some embodiments.
Figure 12:
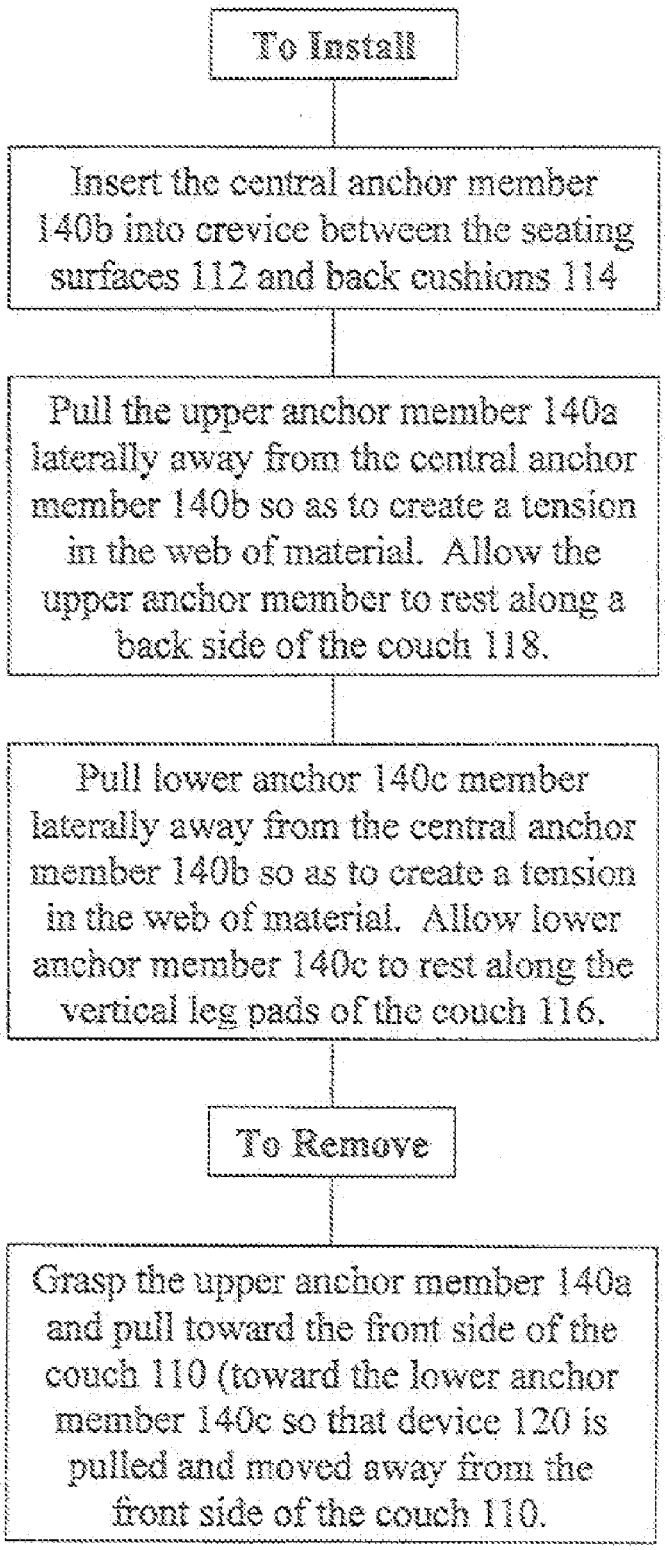
FIG. 12 is a flow chart describing a process for using a furniture covering device, in accordance with some embodiments Like reference symbols in the various drawings indicate like elements.

Referring now to FIGS. 10-12, some methods of using the furniture cover device 120 can provide added convenience to a user while also protecting the underlying furniture piece 110. As shown in FIG. 10, some embodiments of the device 120 may be installed onto a piece of furniture 110 by first inserting the central anchor member 140*b* into crevice 115 between the seating surfaces 112 and back cushions 114. The user may pull the upper anchor member 140*a* laterally away from the central anchor member 140*b* so as to create a tension in the second body portion 128. Then, the user can move the upper anchor member 140 to rest along a back side of the couch 118 (with the second body portion 128 extending over the top face of the furniture piece 110), thereby retaining the second body portion 128 is in slight tension when resting against the back cushions 114. In this process, the user can also pull the lower anchor 140*c* member laterally away from the central anchor member 140*b* so as to create a tension in the first body portion 126. The, the user may move the lower anchor member 140*c* to rest along vertical leg pads of the couch 116 (proximate to the ground) so that the first portion of the main body 126 is in slight tension when resting on the seating surfaces 112.

Referring to FIGS. 11-12, some embodiments of the device 120 may be removed from a piece of furniture 110 using a one-armed motion for prompt removal. In one example method, the device 120 can be removed by grasping the central anchor member 140*b* and lifting away from seating surfaces 112 and back cushions 114. Alternatively, the user may grasp the lower anchor member 140*c* and lift over the back side of the couch (toward the upper anchor member 140*a* so that device 120 is lifted and moved away from the backside of the couch 110. Alternatively, the user may grasp upper anchor member 140*a* and pull toward the front side of the couch 110 (toward the lower anchor member 140*c* so that device 120 is pulled and moved away from the front side of the couch 110.

In some alternative embodiments, the furniture cover device 120 may include only two anchor members 140 arranged in two longitudinal channels 135 of the main body 122. For example, two anchor members 140 can be arranged proximate to opposing ends of the main body 122 with a central anchor member arranged therebetween. In these circumstances, the main body 122 may comprise a single body portion, which is at least partially defined between the two anchor members 140 proximate to opposing ends of the main body 122. In this embodiment, the single body portion can be configured to install over one or more seating surface cushions of the furniture piece 110, while the back cushions remain generally exposed. In another scenario, the single body portion can be configured to install over one or more back cushions of the furniture piece 110, while the seating surface remain generally exposed. In these alternative embodiments, the cover device 120 may include two longitudinal channels 135, such as a lower channel adjacent to a lower edge of the main body 122 and an upper channel adjacent to an upper edge of the main body 122. As previously described, the elongate anchor members 140 may serve as weighted portions that retain the main body 122 in a selected position on the furniture piece 110. Each of the elongate anchor members 140 can be removably received in the main body 122 through the longitudinal channels 135 such that a user can readily remove the elongate anchor members 140 from the main body 122 (for purposes cleaning the main body 122).

A number of embodiments of the invention have been described. Nevertheless, it will be understood that various modifications may be made without departing from the spirit and scope of the invention. Accordingly, other embodiments are within the scope of the following claims.

What is claimed is:

1. A furniture protection system, comprising:

a furniture piece selected from the group consisting of a couch, a loveseat, a chair, and a chase, the furniture piece comprising one or more seating surface cushions, one or more back cushions extending from the seating surface cushions toward a top side of the furniture piece, a longitudinal gap defined between the one or more seating surface cushions and the one or more back cushions;

a furniture cover device removably mounted to the furniture piece so as to at least partially cover the one or more seating surface cushions and the one or more back cushions, the furniture cover device comprising:

a main body comprising a web of flexible material that defines a plurality of longitudinal channels extending substantially the entire longitudinal length of the main body;

a plurality of elongate anchor members arranged in the plurality of longitudinal channels, each elongate anchor member being removably received in a corresponding one of the longitudinal channels such that the plurality of elongate anchor members extend in a longitudinal direction generally parallel to one another;

wherein the furniture cover device is retained in a selected position on the furniture piece when a central elongate anchor member of the plurality of elongate anchor members is arranged in the longitudinal gap defined between the one or more seating surface cushions and the one or more back cushions.

2. The furniture protection system of claim 1, wherein the web of flexible material of the furniture cover device includes a front layer and a rear layer secured together to define three longitudinal channels, the three longitudinal channels including a lower longitudinal channel positioned adjacent to a lower edge of the furniture cover device, an upper longitudinal channel positioned adjacent to an upper edge of the furniture cover device, and a central longitudinal channel positioned between the upper and lower longitudinal channels.

3. The furniture protection system of claim 2:

wherein a first body portion of the web of flexible material is at least partially defined between the lower longitudinal channel and the central longitudinal channel and a second body portion of the web of flexible material is at least partially defined between the upper longitudinal channel and the central longitudinal channel, wherein the plurality of elongate anchor members includes a lower elongate anchor member slidably received in the lower longitudinal channel, a central elongate anchor member slidably received in the central longitudinal channel, and an upper elongate anchor member slidably received in the upper longitudinal channel, wherein each of the lower, central, and upper elongate anchor members extend substantially the entire longitudinal length of the furniture cover device and extend generally parallel to one another, and wherein when the furniture cover device is retained in the selected position on the furniture piece, the lower elongate anchor member creates tension in the first body portion of the web of flexible material and the upper elongate anchor member creates tension in the second body portion of the web of flexible material.

4. The furniture protection system of claim 3, wherein each of the three longitudinal channels has a length that is greater than a length of each of the plurality of elongate anchor members, and wherein each of the three longitudinal channels has ends that are closed by releasable fasteners.

5. The furniture protection system of claim 2, wherein each of the three longitudinal channels is defined between inner faces of the front layer and the rear layer so that an interior of each of the three longitudinal channels is generally concealed.

6. The furniture protection system of claim 2, wherein at least one of the three longitudinal channels is defined by the front layer and the rear layer being secured together to form a longitudinal loop structure.

7. The furniture protection system of claim 1, wherein the web of flexible material comprises a flexible material selected from the group consisting of fleece, canvas, duck cloth, flannel, polymer sheeting, or a polymer-fabric blend.

8. The furniture protection system of claim 1, wherein the main body of the furniture cover device has a width of about 20 inches to about 80 inches, and a height of about 60 inches to about 90 inches.

9. The furniture protection system of claim 1, wherein the web of flexible material of the furniture cover device includes a single layer of material having longitudinal portions secured together to define three longitudinal channels.

10. A furniture cover device, comprising:

a furniture covering body comprising a web of flexible material that defines three longitudinal channels extending substantially the entire longitudinal length of the furniture covering body, the web of flexible material comprising a front layer and a rear layer secured together to define the three longitudinal channels, the three longitudinal channels including a lower longitudinal channel positioned adjacent to a lower edge of the furniture covering body, an upper longitudinal channel positioned adjacent to an upper edge of the furniture covering body, and a central longitudinal channel positioned between the upper and lower longitudinal channels, wherein a first body portion of the web of flexible material is at least partially defined between the lower longitudinal channel and the central longitudinal channel and a second body portion of the web of flexible material is at least partially defined between the upper longitudinal channel and the central longitudinal channel; and three elongate anchor members comprising a flexible elastomeric material and being removably coupled with the web of flexible material, the three elongate anchor members including a lower elongate anchor member slidably received in the lower longitudinal channel, a central elongate anchor member slidably received in the central longitudinal channel, and an upper elongate anchor member slidably received in the upper longitudinal channel, wherein each of the lower, central, and upper elongate anchor members extend substantially the entire longitudinal length of the furniture covering body and extend generally parallel to one another, wherein when the central elongate anchor member is removably mounted to a furniture piece, the lower elongate anchor member creates tension in the first body portion of the web of flexible material and the upper elongate anchor member creates tension in the second body portion of the web of flexible material.

11. The furniture cover device of claim 10, wherein each of the three longitudinal channels has a length that is greater than a length of each of the three elongate anchor members, and wherein each of the three longitudinal channels has ends that are closed by releasable fasteners.

12. The furniture cover device of claim 11, wherein each of the three longitudinal channels is defined between inner faces of the front layer and the rear layer so that an interior of each of the three longitudinal channels is generally concealed.

13. The furniture cover device of claim 11, wherein at least one of the three longitudinal channels is defined by the front layer and the rear layer being secured together to form a longitudinal loop structure.

14. The furniture cover device of claim 11, wherein the web of flexible material comprises a flexible material selected from the group consisting of fleece, canvas, duck cloth, flannel, polymer sheeting, or a polymer-fabric blend.

15. The furniture cover device of claim 14, wherein the main body has a width of about 20 inches to about 80 inches, and a height of about 60 inches to about 90 inches.

16. The furniture cover device of claim 10, wherein the web of flexible material of the furniture covering body includes a single layer of material having longitudinal portions secured together to define each of the lower longitudinal channel, the central longitudinal channel, and the upper longitudinal channel.

17. A method of using a furniture covering device on a furniture piece, comprising:

inserting a central elongate anchor member into a crevice between at least one seating surface cushion and at least one back cushion of a furniture piece, the central elongate anchor member being removably received in a central longitudinal channel extending through substantially an entire longitudinal length of a web of material of a furniture covering device;

positioning a lower elongate anchor member laterally away from the central elongate anchor member and adjacent to a vertical leg pad of the furniture piece so as to create tension in the web of material, the lower elongate anchor member being removably received in a lower longitudinal channel extending through substantially the entire longitudinal length of the web of material proximate to a lower edge of the web of material;

positioning an upper elongate anchor member laterally away from the central elongate anchor member and adjacent to a back portion of the furniture piece so as to create tension in the web of material, the upper elongate anchor member being removably received in an upper longitudinal channel extending through substantially the entire longitudinal length of the web of material proximate to an upper edge of the web of material; and lifting at least one of the central, lower, and upper elongate anchor members away from the furniture piece so as to remove the furniture covering device away from the furniture piece with a single arm motion.

18. The method of claim 17, wherein the web of material of the furniture covering device includes a front layer and a rear layer secured together to define the central longitudinal channel, the lower longitudinal channel, and the upper longitudinal channel, wherein a first body portion of the web of material is at least partially defined between the lower longitudinal channel and the central longitudinal channel and a second body portion of the web of material is at least partially defined between the upper longitudinal channel and the central longitudinal channel, each of the central elongate anchor member, the lower elongate anchor member, and the upper elongate anchor member extend generally parallel to one another.

19. The method of claim 17, wherein each of the central longitudinal channel, the lower longitudinal channel, and the upper longitudinal channel has a length that is greater than a length of each of the central elongate anchor member, the lower elongate anchor member, and the upper elongate anchor member, and wherein each of the central longitudinal channel, the lower longitudinal channel, and the upper longitudinal channel has ends that are closed by releasable fasteners.

20. The method of claim 17, wherein the web of material of the furniture covering device includes a single layer of material having longitudinal portions secured together to define each of the central longitudinal channel, the lower longitudinal channel, and the upper longitudinal channel.

* * * * *